United States Patent [19]

Karasawa et al.

[11] 4,351,604

[45] Sep. 28, 1982

[54] MULTI-COLOR ELECTROSTATIC COPYING APPARATUS

[75] Inventors: Shuichi Karasawa; Fuyuhiko Matsumoto; Kunihiko Ikeda; Shuichi Tsushima, all of Tokyo, Japan

[73] Assignee: Ricoh Company, Ltd., Tokyo, Japan

[21] Appl. No.: 142,600

[22] Filed: Apr. 22, 1980

[30] Foreign Application Priority Data

Apr. 26, 1979 [JP] Japan ..... 54-51916
Jun. 12, 1979 [JP] Japan ..... 54-73742
Jun. 21, 1979 [JP] Japan ..... 54-78577

[51] Int. Cl.[3] ..... G03G 15/01

[52] U.S. Cl. ..... 355/4; 118/653; 118/656; 118/656; 118/661; 209/127 R; 209/128; 209/129; 209/130; 355/3 DD

[58] Field of Search ..... 355/3 R, 3 DD, 4; 118/653, 655, 656, 657, 658, 661; 209/127 R, 128, 129, 130, 131

[56] References Cited

U.S. PATENT DOCUMENTS 3,306,193 2/1967 Rarey et al. ..... 118/655 X
3,477,568 11/1969 Madrid ..... 209/127 R
3,662,884 5/1972 Robinson ..... 209/129
3,911,865 10/1975 Volkers ..... 118/655 X
3,960,738 6/1976 O'Brien et al. ..... 209/129 X
4,101,215 7/1978 Fottner et al. ..... 355/15
4,142,165 2/1979 Miyakawa et al. ..... 118/657 X
4,189,224 2/1980 Sakai ..... 355/4
4,226,524 10/1980 Hashimoto ..... 118/657 X
4,264,185 4/1981 Ohta ..... 355/4

*Primary Examiner*—Fred L. Braun
*Attorney, Agent, or Firm*—David G. Alexander

[57] ABSTRACT

First and second developing units (66), (67) apply toners of first and second colors respectively to a photoconductive drum (61) carrying a bipolar electrostatic image to form a bicolor toner image. A small amount of the first toner is scraped off the drum (61) in the second developing step and becomes mixed with the second toner in the second developing unit (67). The admixed first toner is separated and removed from the second toner by a separation member in the form of a roller, belt or mesh covered electrode (81) which is charged to a polarity opposite to the first toner and electrostatically attracts the same while repelling the second toner.

25 Claims, 27 Drawing Figures

RED LIGHT
126
124
123
122
121

127
124
123
122
121

WHITE
RED
BLACK
124
123
122
121

BLACK
RED
124
123
122
121

MULTI-COLOR ELECTROSTATIC COPYING APPARATUS

BACKGROUND OF THE INVENTION

The present invention relates to a multi-color electrostatic copying apparatus. Although illustrated and described as being applied to a two color apparatus, the present invention is not so limited and may be applied to an apparatus for copying in three or more colors.

In such an apparatus, a bipolar electrostatic image formed on a dielectric member is sequentially developed by toners of first and second different colors to form a bicolor toner image which is transferred and fixed to a copy sheet. The problem is that a small amount of the first toner is scraped off the dielectric member during the second developing step and becomes mixed with the second toner. Although the amount of mixed first toner is small, it can accumulate with time and degrade the color and electrostatic charge of the second toner image. The dielectric member may be a photoconductive drum or belt in which case the electrostatic image is formed through localized photoconduction or may be a non-photoconductive member in which case the electrostatic image is formed through electrostatic induction.

In a copying apparatus using liquid toners, the first toner may be removed from the second toner by making use of an electrostatically charged, non-image area of the dielectric member. However, this expedient is not usable in a dry copying apparatus.

SUMMARY OF THE INVENTION

A multi-color electrostatic copying apparatus embodying the present invention includes a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, and is characterized by comprising toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity.

In accordance with the present invention, first and second developing units apply toners of first and second colors respectively to a photoconductive drum carrying a bipolar electrostatic image to form a bicolor toner image. A small amount of the first toner is scraped off the drum in the second developing step and becomes mixed with the second toner in the second developing unit. The admixed first toner is separated and removed from the second toner by a separation member in the form of a roller, belt or mesh covered electrode which is charged to a polarity opposite to the first toner and electrostatically attracts the same while repelling the second toner.

It is an object of the present invention to provide a bicolor electrostatic copying apparatus comprising means for preventing mixing of differently colored toners.

It is another object of the present invention to provide a bicolor electrostatic copying apparatus which produces consistently improved color purity over the prior art.

It is another object of the present invention to provide a generally improved multi-color electrostatic copying apparatus.

Other objects, together with the foregoing, are attained in the embodiments described in the following description and illustrated in the accompanying drawing.

DESCRIPTION OF THE PREFERRED EMBODIMENTS

While the multi-color electrostatic copying apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
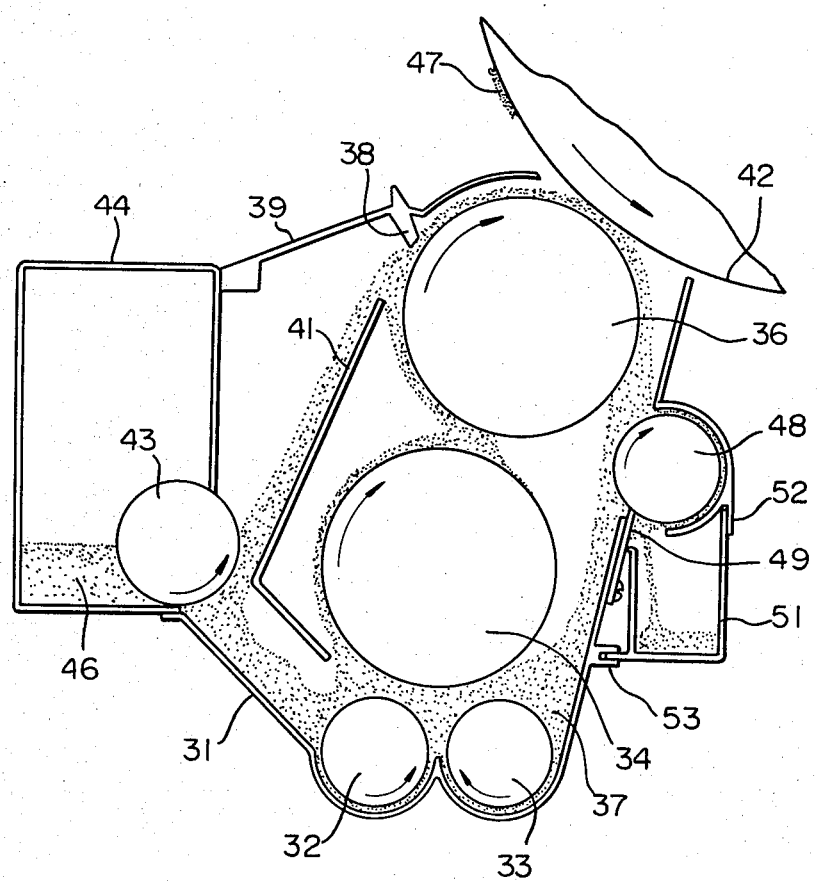
FIG. 1 is a fragmentary schematic view of a first electrostatic copying apparatus embodying the present invention.

A preferred embodiment of the present invention will now be described with reference to the accompanying drawing. FIG. 1 illustrates only the second developing unit of a developing system according to the invention. The second developing unit includes a container 31 having in a bottom portion thereof a pair of rotary shafts 32 and 33 which rotate upwardly in their adjacent area. A rotatable draw-up roller 34 is positioned above the shafts 32 and 33 and a rotatable developing roller 36 above the draw-up roller 34. Each of the rollers 34 and 36 comprises a non-magnetic rotary sleeve and stationary magnets housed in the non-magnetic sleeve. Developer 37 stored in the container 31 is made up of magnetic carrier particles and resinous toner particles. The shafts 32 and 33 in combination agitate the developer 37 whereby the carrier and toner particles are charged to opposite polarities and the relatively small toner particles are adhered to the relatively large carrier particles. Then the developer 37 is adhered onto the surface of the roller 34 by the magnets in the roller 34. The rotating roller 34 conveys the developer 37 upward until the latter adheres to the surface of the adjacent developing roller 36 in accordance with the magnetic attraction exerted by the magnets in the roller 37. While being conveyed further upward by the roller 36, the developer 37 has its thickness on the roller 36 regulated by a doctor blade 38 which protrudes into the container 31 from a cover member 39. The part of the developer 37 shaved off by the doctor blade 38 flows down a guide plate 41 to the bottom of the container 31. Meanwhile, the developer 37 on the roller 36 which moved past the doctor blade 38 contacts the surface of a photoconductive or photosensitive drum 42 in a position where the roller 36 and drum 42 are adjacent to each other, thus developing a bipolar electrostatic latent image carried on the drum 42. After the development, the developer 37 drops by gravity from the developing roller 36 and is collected in the bottom portion of the container 31. More specifically, since no magnetic poles are arranged in the portion of the roller 36 where the developer 37 is to drop, the developer 37 freed from the magnetic force falls from said portion by gravity. A roller 43 associated with a toner tank 44 serves to supply the container 31 with a fresh supplementary amount of toner 46 which makes up for the consumption of toner particles during development.

The photosensitve drum 42 already carries a toner image 47 formed by a first developing unit before reaching the second developing unit and, therefore, the developer 37 on the roller 36 rubs the toner image 47. While the toner image 47 on the drum 42 has adhered electrostatically in accordance with the charge of the latent image on the drum 42, the adhering force progressively decreases from the innermost part to the outermost in the radial direction of the drum 42. Consequently, the developer 37 on the roller 36 scrapes the toner particles in the outermost part of the toner image 47 due to mechanical sliding friction force whereby the scraped away toner particles are admixed with the developer 37. The admixture is separated from the developer 37 by a separator roller 48 which is rotatably mounted to a side wall of the container 31 in a position where the developer 37 drops from the roller 36. The roller 48 comprises a known conductive metal member whose outer periphery is covered with an insulating layer; the insulating layer is of the type which will be charged to a polarity opposite to that of the alien toner particles when in frictional contact with the occupant carrier of the developer 37. Alternatively, the roller 48 may consist only of a conductive metal member connected to an external d.c. power source to be applied with a potential opposite in polarity to the admixture. The alien toner particles thus deposited on the roller 48 are shaved off therefrom by a scraping member 49 located below the roller 48 and then collected in a container 51 mounted to the side wall of the container 31. The container 51 is detachably engaged with guides 52 and 53 provided to the side wall of the container 31. When the toner collected in the container 51 reaches a certain amount, the container 51 may be detached from the guides 52 and 53 to return the toner to a first developing unit.

In summary, a developing system according to the present invention assures separation and collection of admixed or alien particles of toner by means of a separator roller located in a position where a developer falls thereon and a container detachably mounted to a developing unit to collect the alien toner particles. It will be noted that the present invention is applicable not only to the illustrated magnetic brush developing system but to a cascade developing system. It will also be noted that use may be made of a single component developer in place of a developer of the type described in connection with the illustrated embodiment.

Figure 2:
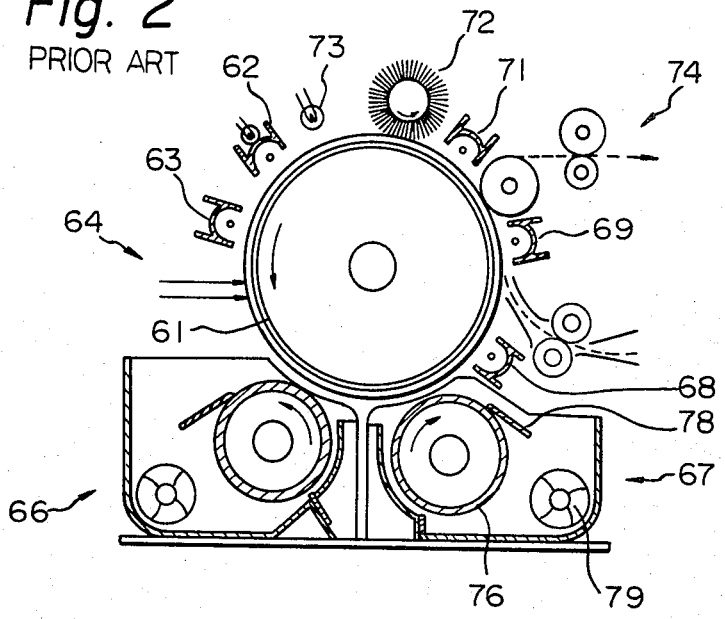
Fig. 2 PRIOR ART
FIG. 2 is a schematic view of a prior art electrostatic copying apparatus.

Referring to FIG. 2, there is shown an exemplary arrangement of bicolor electrophotocopying machine to which a system of the invention is suitably applicable. The reference numeral 61 denotes a multi-layer photosensitive drum for bicolor development.

Arranged around the drum 61 in succession are a primary charger 62, a secondary charger 63, an exposure station 64, a first developing unit 66, a second developing unit 67, a charger 68, a transfer charger 69, a charger 71 for charge dissipation, a cleaning brush 72 and a quenching lamp 73. Designated by the reference numeral 74 is a fixing device.

The first and second developing units 66 and 67 are commonly of the known magnetic brush type and employ developers each consisting of a toner and a carrier. Let it be assumed for convenience sake that the toner stored in the first developing unit 66 is red and the toner in the second developing unit 67 charged oppositely to the red toner is black.

Briefly described, the copying machine shown in FIG. 2 is operated to cause the first developing unit 66 to develop an electrostatic latent image on the drum 61 corresponding to a red image on a document and, likewise, the second developing unit 67 a latent image corresponding to a black image. When the second developing unit 67 develops a latent image allocated thereto with the black toner charged oppositely to the red toner, the red toner image on the drum 61 developed by the first unit 66 is brought into contact with the magnetic brush of the second unit 67 and thereby partly shaved off. This scraped part of the red toner falls into the second unit 67 and is mixed with the black toner. Also, the black toner may be introduced in the first unit 66 to mix with the red toner thereinside.

The present invention contemplates to separate and remove an alien toner of one color which is about to mix or has mixed with an occupant toner of another color.

Figure 3:
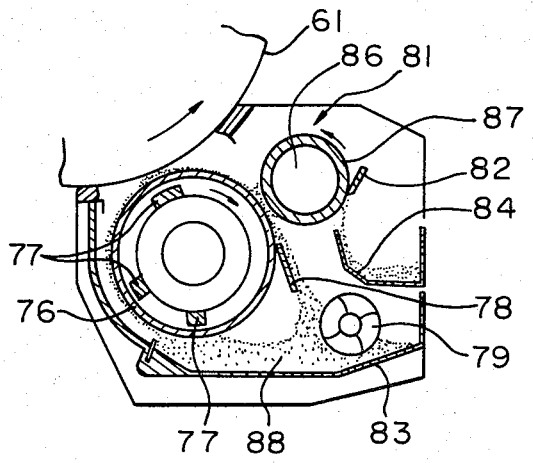
FIG. 3 is a fragmentary schematic view illustrating how the present invention improves on the copying apparatus of FIG. 2.

A preferred embodiment of the present invention will hereinafter be described taking the second developing unit 67 for example. As shown in FIG. 3, the developing unit 67 comprises a sleeve 76 rotatable as indicated by an arrow and accommodating multiple magnets 77 in fixed positions therein, a plate 78 for scraping the developer made up of a black toner and a carrier off the surface of the sleeve 76 after development, an agitating member 79, a separator roller 81, another scraping plate 82 held in contact with the separator roller 81, a developer container 83, and a toner collecting container 84.

The separator roller 81 comprises a conductive metal roller 86 whose outer periphery is covered with an insulating layer 87. The separator roller 81 rotates as indicated by an arrow while having its insulating layer 87 located adjacent to the sleeve 76. The layer 87 is made of an insulating material which, when in frictional contact with carrier particles, will be charged opposite in polarity to particles of the alien toner which is the red toner in the illustrated case. Where the red toner is charged negatively, the insulating material 87 may be selected from polytetrafluoroethylene, polyethylene and like known substances which can be charged positively in the above situation. Alternatively, the friction between the scraper 82 and insulating layer 87 may be utilized to charge the layer 87 to a polarity opposite to that of the red toner.

As the part of the drum 61 carrying the red toner image provided by the first unit 66 reaches the second developing unit 67, the red toner image is rubbed and partly scraped off from the drum 61 by the magnet brush on the sleeve 76 consisting of a developer 88. At this instant, the latent image on the drum 61 corresponding to a black image on a document is naturally developed by the black toner contained in the developer 88.

The scraped particles of the red toner are conveyed by the rotating sleeve 76 toward the container 83. However, the separator roller 81 charged oppositely to the red toner particles by friction with carrier particles attracts the red toner particles in a position neighboring the separator roller 81.

The red toner particles thus transferred onto the separator roller 81 are then scraped off by the scraper 82 and gathered in the collector 84. Meanwhile, the black toner particles on the sleeve 76 after the development are returned by the scraper 78 into the container 83 without adhering to the separator roller 81 since the polarity of such particles is the same as that of the separator roller 81.

Thus, a part of the red toner supplied from the first developing unit 66 (see FIG. 2) to the drum 61 which has been shaved off by the second developing unit 67 is separated from the black toner by the separator roller 81 before entering the container 83 of the second unit 67. This prevents the alien red toner from mixing with the developer 88 containing the occupant black toner.

In the embodiment shown in FIG. 3, the charge on the separator roller 81 is derived from the friction between the insulating layer 87 of the roller 81 and carrier particles supporting black toner particles. This is impossible unless the developer 88 stored in the second developing unit 67 is of the type having toner and carrier particles in combination.

Developers are available in two different compositions, one of which comprises toner and carrier particles as mentioned above and the other of which comprises magnetic toner particles alone.

In the case of a developing device using the latter one-component type developer, the separator roller 81 needs to be charged by the friction between the scraper 82 and layer 87 or by positively charging the separator roller 81 itself due to the absence of carrier particles.

Figure 4:
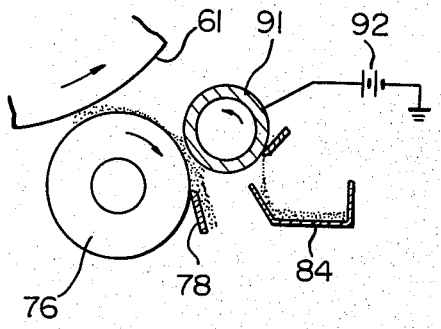
FIGS. 4 and 5 illustrate modifications of the improvement of FIG. 3.

In an arrangement illustrated in FIG. 4, a separator roller 91 comprises a biased roller member formed of a conductive material and connected to a d.c. power source 92 which supplies the roller 91 with a polarity capable of attracting an alien toner, red toner in this case, and a sufficiently high voltage. This type of arrangement with the separator roller 91 charged positively further enhances the separation and removal of alien toner particles and, moreover, it can be operated with either one-component or two-component developers.

Figure 5:
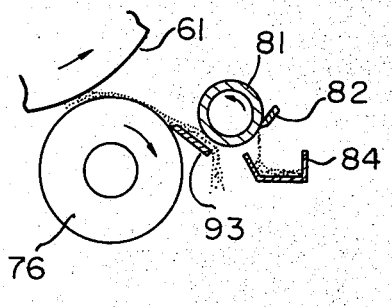

The two embodiments discussed above commonly include a separator roller and a sleeve adjacent to each other and cause alien toner particles removed by the separator roller to be transferred from the surface of the sleeve. Another arrangement illustrated in FIG. 5 includes a scraper plate 93 so positioned as to remove all the toner particles from the sleeve 76. With this arrangement, the removed toner particles flow down the scraper plate 93 and in the vicinity of the separator roller 81 so that the separation and removal can further be enhanced.

Figure 6:
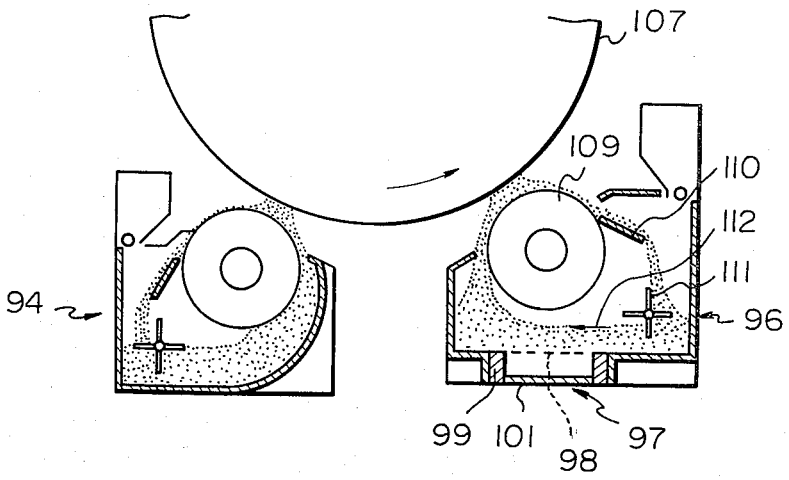
Fig. 6 PRIOR ART
FIG. 6 is a schematic view of another prior art electrostatic copying apparatus.
Figure 7:
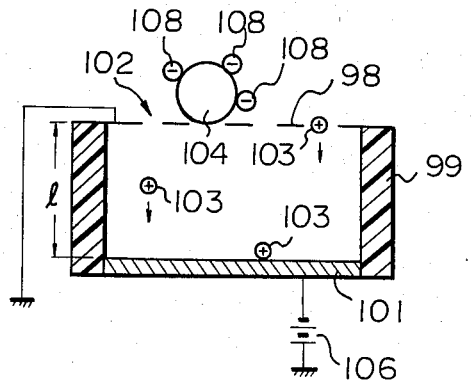
FIG. 7 is a schematic view illustrating how the present invention improves on the copying apparatus of FIG. 6.

Each of the foregoing embodiments has been shown and described as separating particles of an alien toner before they mix with an occupant developer. Reference will now be had to FIGS. 6 and 7 for describing a system which separates toner particles which have mixed with the occupant developer.

Referring to FIG. 6, denoted by the reference numerals 94 and 96 are first and second developing units, respectively. The second unit 96 in this embodiment stores a two-component developer made up of black toner and carrier while the first unit 94 stores a two-component developer consisting of red toner and carrier or a one-component developer comprising red toner.

The second developing unit 96 has separation/removal means 97 therewith for removing an alien toner. As best shown in FIG. 7, the means 97 comprises a conductive mesh 98, an insulating support 99 and a conductive electrode member 101.

The mesh 98 has apertures 102 which allow toner particles 103 to pass therethrough but not carrier particles 104. The diameter of the aperatures 102 may range substantially from 30 μm to 50 μm in view of the fact that two-component developers generally used for electrophotography have carrier particles of 60–300 μm in size and toner particles of 3–20 μm. However, the aperture diameter is suitably selectable in accordance with the type of developer employed.

A power source 106 develops a potential difference between the mesh 98 and electrode 101. An electric field applied across the mesh 98 and electrode 101 may be on the order of 100–10000 V/cm.

In FIG. 6, a drum 107 rotating as indicated by an arrow has its latent image corresponding to an original red image developed by the red toner 103 supplied thereto from the first developing unit 94. Thereafter, a latent image on the drum 107 corresponding to an original black image is developed by the second developing unit 96 which has a magnetic brush of black toner 108 and carrier 104. The red toner image on the drum 107 is partly scraped off by the second unit 96 and falls onto a sleeve 109. The black toner $T_B$ and carrier C joined in the development and now containing particles of the red toner $T_R$ are removed from the sleeve 109 by a scraper 110 onto a agitating member 111.

A member 111 agitates the developer and feeds it as indicated by an arrow 112 until the developer is again supplied onto the surface of the sleeve 109. Here, the separator means 97 is positioned in the path of the developer from the member 111 to the member 109 so as to remove the admixed red toner from the occupant developer.

More specifically, in FIG. 7, the potential difference between the mesh 98 and electrode 101 causes the red toner 103 which reaches the mesh 98 to fall onto the electrode 101 through the apertures 102 and thus be separated from the occupant black toner 108 and carrier 104. It will be apparent that, though smaller in diameter than the apertures 102, the black toner 108 advances along the mesh 98 without falling through the apertures 102 because it is electrostatically adhered to the carrier 104 whose diameter is larger than that of the apertures 102.

It may occur that the electrode 101 fails to attract the red toner particles mixed in the developer which is travelling on the mesh 98 in a relatively dense state. To cope with this problem, a suitable device may be employed to oscillate the mesh 98.

Additionally, an electric field may be applied across the sleeve 109 and mesh 98 to promote attraction of the red toner particles to the neighborhood of the mesh 98. This will facilitate the removal of the alien toner. For instance, in a magnetic brush developing process, an electric field can be applied across a developing roller (represented by the sleeve 109 in the drawings) and the mesh 98 by utilizing a bias voltage usually supplied to the sleeve 109 to avoid adhesion of toner particles to that area of the photosensitive drum 107 where latent images are absent.

Experiments were performed as described hereinafter.

For the experiments, use was made of a photosensitive drum 107 of the type which, when exposed to image light from a document carrying red, black and white areas thereon, develops a potential of −600 V in a red image area, a potential of 800 V in a black image area and a potential of 0 V in a white image area. A developer in the first developing unit 94 consisted of a red toner (positively charged) having an average particle size of 10 μm and an average charge density of 12 μC/g and a carrier having an average particle size of 100 μm. A developer in the second developing unit 96 consisted of a black toner (negatively charged) having an average particle size of 12 μm and an average charge density of −15 μC/g and a carrier of a 120 μm average particle size. A copying cycle including known charging and exposing, first and second development and transfer was repeated. The total amount of developer in each of the first and second units 94 and 96 was 1 kg while the toner density was 2.5 Wt% in the first unit 94 and 3 Wt% in the second unit 96.

First, the copying cycle was repeated without installing the separating means 97. After the production of about 2000 copies, it was found that red toner particles stuck to a black portion of the copy. Significant mixing of red toner particles in a black portion was observed when the number of copies reached about 5000.

Then, as shown in FIG. 6, the separating means 97 was mounted in the second developing unit 96 and the copying cycle was repeated under the same conditions. The mesh 98 was grounded while the electrode 101 was applied with a voltage of −800 V. The mesh 98 and electrode 101 were spaced a distance of 5 mm. The mesh 98 was made of copper and the openings 102 had a diameter of 45 μm. The electrode 101 was made of aluminum while the insulative support 99 was made of Bakelite. The electrode 101 was detachably mounted to the second developing unit 96.

With the separating means 97, repeated copying cycles caused no sticking of red toner particles to black portions of copies even when the copies totalled 5000 sheets. The total amount of red toner particles collected on the electrode 101 was 10 g.

A developing system according to the present invention provides clear-cut copies by preventing alien toner from sticking to an area which is expected to receive an occupant toner. When the alien toner mixed with the occupant toner is not separated, the density of the red toner in the second unit in the drawings will progressively increase to vary the charge of the black toner thereby degrading images provided by the black toner. This can be avoided in accordance with the system of the invention.

It will be apparent that, while separating means have been shown and described as being installed only in the second developing unit 67 or 96, they may be provided also in the first developing unit 66 or 94.

There has been proposed a bicolor copying process in which a latent image carrier has formed thereon latent images corresponding to A-color and B-color light images on the white background of an original document on the basis of a distribution of positive surface potential and negative surface potential. The different latent images on the common image carrier are developed sequentially by differently colored and oppositely charged first and second toners.

Where the image carrier is in the form of a photoconductive or photosensitive element, latent images will be formed thereon by employing a specific combination of charging and exposing steps. In the case of a dielectric image carrier, latent images will be provided by selective charging of multiple styluses or the like.

A typical example of a bicolor copying process using a photoconductive or photosensitive element is illustrated in FIGS. 8*a* to 8*d*.

Though in principle any desired combination of colors A and B is available for such a process, the color A is taken to be black and the color B red for the sake of description. Naturally, the color A may be red and the color B black. It is not essential that the colors $\alpha$ and $\beta$ of toners used for development be the same as the colors A and B of bicolor images on a document. However, let it be assumed that the color A is the same as the color $\alpha$ and the color B the color $\beta$ and that the color $\alpha$ is black and the color $\beta$ is red.

With this assumption, the process shown in FIGS. 8*a* to 8*d* will be described briefly.

A photosensitive element 121 comprises a conductive substrate 122 on which first and second photoconductive layers 123 and 124 are stratified in succession. The layer 123 is made of a photoconductive material which is insensitive to red light. The layer 124 on the other hand is made of a photoconductive material which is sensitive to red light.

Figures 8A, 8B, 8C, 8D:
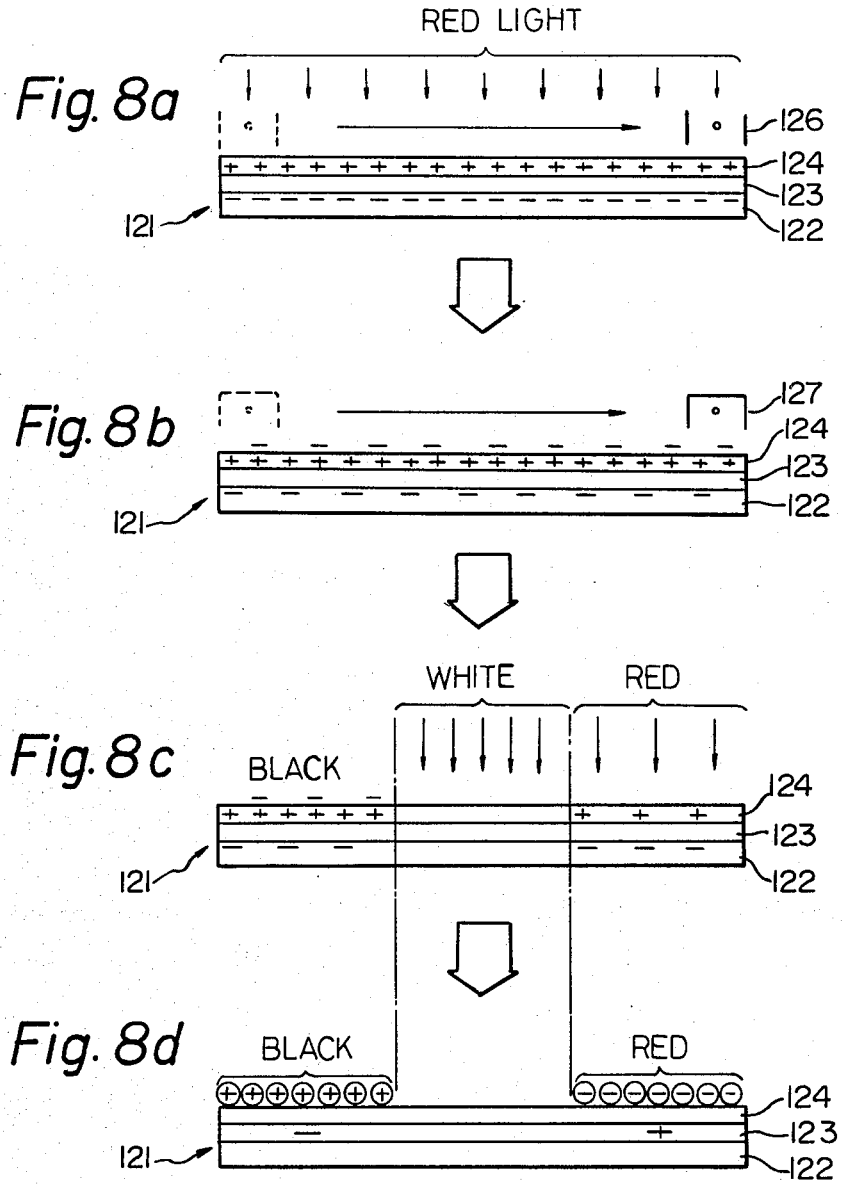
FIGS. 8*a* to 8*d* are diagrams illustrating an electrostatic copying process of the present invention.

While the photosensitive element 121 is illuminated in FIG. 8*a* by red light to render only the layer 124 conductive, a charger 126 deposits a primary charge of a given polarity, which is positive in the illustrated case, on the photosensitive element 121. This causes a positive charge to be distributed evenly at the interface between the photoconductive layers 123 and 124.

Then a second charger 127 is energized in FIG. 8*b* in the dark to deposit a secondary charge of a polarity opposite to the primary charge on the photosensitive element 121. The amount of negative charge provided by the secondary charging is predetermined to be somewhat smaller than that of the positive charge originating from the primary charging. Also, the polarity of the surface potential on the photosensitive element 121 is predetermined to be inverted from positive to negative by the secondary charging.

Thereafter, the photosensitive element 121 is exposed to a light image of a bicolor original document in FIG. 8*c* so that portions of the photosensitive element 121 corresponding to the white background and red image are illuminated by white and red light, respectively, with a portion corresponding to the black image left nonexposed. The layers 123 and 124 become conductive in areas corresponding to the white background whereby the charge is dissipated in said areas to make the surface potential substantially zero. In a portion of the photosensitive element 121 corresponding to the red image, only the second photosensitive layer 124 becomes conductive and, therefore, the negative charge on the surface of the element 121 cancels part of the positive charge distributed between the layers 123 and 124 to make the surface potential positive in polarity. In a portion corresponding to the black image, the surface potential of the element 121 maintains the negative state provided by the primary charge.

Figure 9:
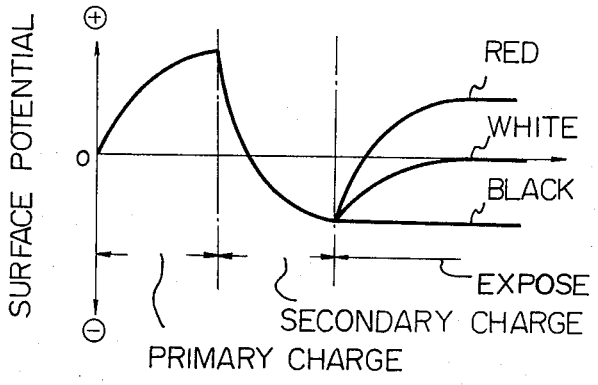
FIG. 9 is a graph illustrating the process of FIGS. 8*a* to 8*d;*

Thus, a positive surface potential distribution and a negative surface potential distribution on the element 121 constitute electrostatic latent images corresponding to the red and black images on the document, respectively. FIG. 9 shows the surface potential of the element 121 up to the step stated above.

The latent image corresponding to the black image is developed by a positively charged black toner while the area corresponding to the red image is developed by a negatively charged red toner as shown in FIG. 8*d*. Thereafter, the bicolor toner images are fixed to the element 121 (in the case of a photosensitive element in the form of a sheet) or transferred to a copy sheet and fixed thereon.

Figure 10:
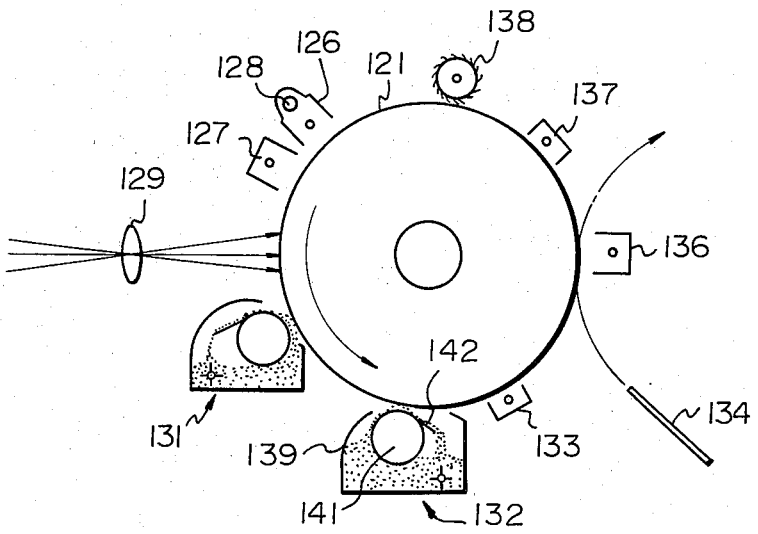
Fig. 10 PRIOR ART
FIG. 10 is a schematic view of a prior art apparatus for practicing the process of FIGS. 8*a* to 8*d;*

Schematically depicted in FIG. 10 is a part of an apparatus for performing such a bicolor copying process. For simplicity, like parts and elements are denoted by the same numerals as those of FIGS. 8*a* to 8*d*.

The photosensitive element 121 in the form of a drum rotates as indicated by an arrow and, first, it is provided with a primary charge by the charger 126. A red lamp 128 is energized to illuminate the drum 121 with red light. Then, the drum 121 undergoes secondary charging by the charger 127 and exposure by an optical system 129 in succession whereby latent images corresponding to red and black areas are formed electrostatically on the drum 121. The latent image corresponding to the black image is developed at a developing unit 131 by a developer containing a black toner whereafter the latent image corresponding to the red image is developed at a second developing unit 132 by a developer containing a red toner. The two toner images of different colors, have a positive charge and a negative charge respectively. A third charger 133 is operated to uniformalize the polarities to, for example, positive. Thereupon, the processed images on the drum 121 are transferred by a transfer charger 136 electrostatically onto a recording sheet 134 and then fixed thereon by a fixing unit (not shown). After the image transfer, the drum 121 has the charge on its surface expelled by a charger 137 and the surface cleaned by a cleaning unit 138. This is the end of the copying process.

Figure 11:
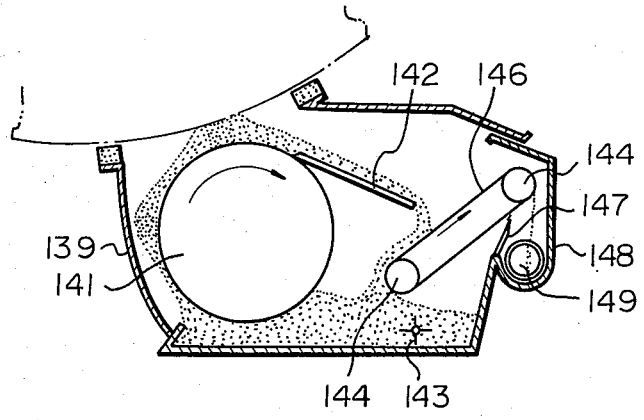
FIG. 11 is a fragmentary schematic view showing how the present invention improves on the apparatus of FIG. 10.

As shown in FIG. 11, a developer stored in a container 139 of the developing unit 132 is magnetically retained on the periphery of a magnetic brush roller or sleeve 141 and conveyed thereby as indicated by an arrow. An unused part of the developer is removed by a separator plate 142 from the sleeve 141.

The sleeve 141 may be of any known type. The reference numeral 143 designates agitating means.

The developer removed by the separator 142 from the sleeve 141 flows down the separator 142 until it drops from the lower end of the separator 142 toward the bottom of the container 139. The part of the developer flowing through such a collection path contains particles of the black toner which the first unit 131 supplied to the drum 121.

A characteristic feature of the present invention resides in that a separating device is located in the collection path for the developer, more specifically at a level of the collection path downstream of the lower end of the separator 142.

In the embodiment shown in FIG. 11, major components of the separating device are a pair of pulleys 144, an endless belt 146 passed over the pulleys 144 and a blade 147. Though not shown, one of the pulleys 144 is driven by a drive mechanism alloted to the separating device and in turn drives the belt 146 as indicated by an arrow. A part of the belt 146 is positioned in the developer collection path to form a part of the collection path. Though not shown, the belt 146 which is formed of a conductive rubber is applied with a potential opposite in polarity to the charge on the black toner, negative potential in this case, from a power source constituting a part of the separating device. The potential applied to the belt 146 is about 50–1000 V in absolute value, preferably about 200–800 V. The conductive rubber forming the belt 146 preferably has a specific volume resistance ranging from about $10^3$ Ωcm to $10^6$ Ωcm and a thickness of 0.5–2 mm.

The belt 146 thus contacts the developer flowing down the collection path and causes only the positively charged black toner to adhere to the belt 146. The belt 146 therefore functions as a member for capturing the black toner. Also captured by the belt 146 are those particles of the red toner which have been charged positively by abnormal charging.

The moving belt 146 conveys the separated toner particles until the blade 147 engaging the belt 146 with its edge scrapes them off the belt 146. The developing unit 132 has in a part thereof a gutter 148. The toner particles scraped off by the blade 147 drop into the gutter 148 and are conveyed by a spiral screw conveyor member 149 which forms a part of the separating device in a direction perpendicular to the drawing sheet. Finally, the toner particles are collected in a collector not shown. Since the alien particles of black toner can be separated from the occupant developer within the collection path, the developer collected in the container 139 will contain no black toner particles or only a negligible amount of the black toner if any. This substantially and effectively solves the conventionally experienced introduction of the black toner into the developer.

Figure 12:
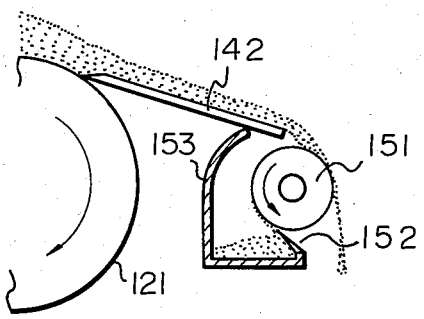
FIGS. 12 to 16 are fragmentary views of modifications of the apparatus of FIG. 11.

The belt 146 may be replaced by another separating or capturing member which takes the form of a roller 151 in FIG. 12. This roller 151 is conductive and provided with a potential opposite in polarity to the charge on the black toner. Denoted 152 is a blade and 153 a collector member; these members serve as black toner removing and collecting means. The roller 151 may be made of a metal or the aforementioned conductive rubber and may be applied with substantially the same potential as the one applied to the belt 146. Alternatively, the roller 151 may comprise a metal roller whose outer periphery is covered with a conductive rubber with a potential on the order of 100–700 V applied to the metal roller.

The spacing between the separator plate 142 and roller 151 is preselected to be smaller than the particle size of the carrier contained in the developer so as to prevent the carrier particles from reaching the collector 153. Though not shown, the roller 151 is naturally driven by a drive mechanism as indicated by an arrow.

Figure 13:
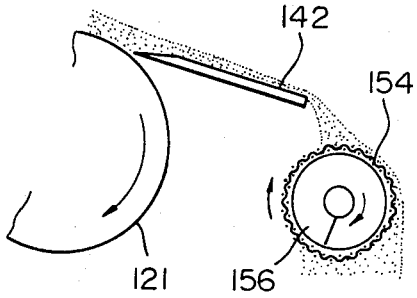

FIG. 13 illustrates another embodiment of the present invention in which major components of the separating device are a mesh roller 154 and a rotary electrode 156.

The mesh roller 154 comprises a hollow tube whose peripheral portion consists of a meshing. A drive mechanism not shown drives the mesh roller 154 for rotation as indicated by an arrow. A material constituting the mesh roller 154 may be selected from suitable ones typified by metals and plastics, but the mesh size is predetermined to be smaller than the particle size of the carrier of the developer. Thus, only the alien toner particles contained in the developer flowing down toward the mesh roller 154 are allowed to enter the mesh roller 154.

Figure 14:
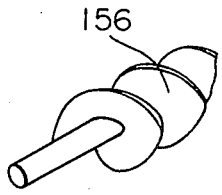

Serving as a capturing member, the rotary electrode 156 as an axis arranged in parallel with that of the mesh roller 154 while being accommodated inside the mesh roller 154. The electrode 156 is applied with a potential opposite in polarity to that of the black toner which is to be separated thereby. This potential applied to the electrode 156 may have an absolute value equal to the potential applied to the belt 146 or the roller 151 already described. In this embodiment, the electrode 146 has a screw form as viewed in FIG. 14 and is operated such that it remains stationary during separation of toner particles and rotates from time to time to convey the black toner accumulated inside the mesh roller 154 in a direction perpendicular to the sheet.

Figure 15:
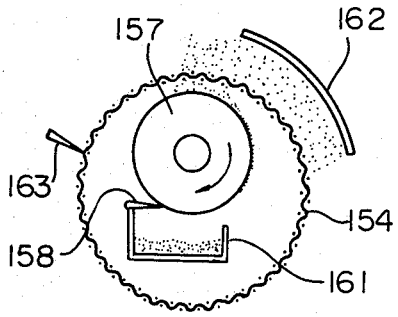
Figure 16:
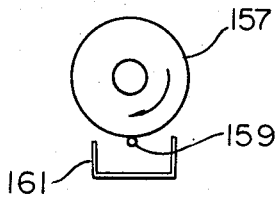

In further embodiments shown in FIGS. 15 and 16, the rotary electrode for capturing toner particles inside the mesh roller 154 is in the form of a roller 157. Denoted 158 is a blade, 159 a wire blade and 161 a collector member. Located immediately below the roller 157, the collector member 161 collects only those toner particles captured by the roller 157. The separating device according to these embodiments may additionally include a guide 162 for the developer and a cleaning blade 163 for the mesh roller 154 as viewed in FIG. 15. Naturally, the roller 157 is applied with a potential opposite in polarity to the charge on the black toner and driven for constant rotation as indicated by an arrow.

The next embodiment relates to a bicolor developing system which develops two latent images formed on a latent image carrier with opposite polarities by supplying two different kinds of developing liquids containing differently colored and oppositely charged toners sequentially from first and second developing units.

In a known process for reproducing bicolor images, two oppositely charged latent images are formed by exposure to an image light or application of signals to such a latent image carrier such as a photosensitive element for an electrophotographic device or a dielectric element for an electrostatic recording device, the two latent images being then developed sequentially by oppositely charged and differently colored toners. Bicolor images on usual documents are frequently in the form of black images and red images on a white background. Typically, red underlines or characters are present locally among black characters or drawings on a white background. Latent images based on such a document are developed first by developing with a red toner the red images occupying a relatively small area and then by developing with a black toner the black images occupying a relatively large area. Stated another way, development with the black toner is effected over the already developed red toner images. As a result, particularly in a process which develops latent images while rubbing the surface of a latent image carrier with a magnetic brush formed by a powdery developer, the magnetic brush containing the black toner partly scrapes off the red toner image and permits it to be admixed with the black toner. Though the amount of the red toner shaved off from the latent image carrier may be very small since the intensity of its electrostatic adhesion is large, the amount progressively increases as the development is repeated and, thus, affects the tone and/or developing characteristic of the black toner. The result is degradation of the quality of reproduced images or mixing of the colors.

Such a problem is not encountered where use is made of liquid developers. Moreover, development with liquid developers is superior to that using powdery developers concerning the reproducibility, contrast and resolution. The use of liquid developers, however, still involves mixing of colors attributable to another cause. Usually, a developing electrode of a liquid development system is applied with a bias voltage of a polarity opposite to the charge polarity of a toner. For instance, where a black toner has a positive charge, the developing electrode of the second developing unit is supplied with a bias voltage which is negative as a charge, which is the same as a latent image corresponding to a black light image. The potential difference between the latent image potential and bias potential develops an electric field directed from the latent image carrier to the developing electrode. When a negatively charged red toner image moves into such an electric field, a part of the red toner adhered to an area where the latent image potential is comparatively small will be removed from the latent image by the electric field and introduced into the second developing liquid.

An object of the present invention is to provide a developing system which separates the red toner admixed with the second liquid developer from this liquid developer before the liquid developer is collected in a container. In a preferred embodiment of the present invention, a developing electrode of the second developing unit is applied with a bias voltage common in polarity to the charge polarity of a black toner so as to positively urge the black toner toward a latent image. Meanwhile, a part of a red toner liable to be separated from the latent image is attracted positively toward the developing electrode and caused to adhere to a separating roller which is positioned in the vicinity of the developing electrode and supplied with a bias voltage common in polarity to but higher than the bias voltage applied to the developing electrode, the separating roller thus removing the red toner admixed in the black toner.

Figure 17:
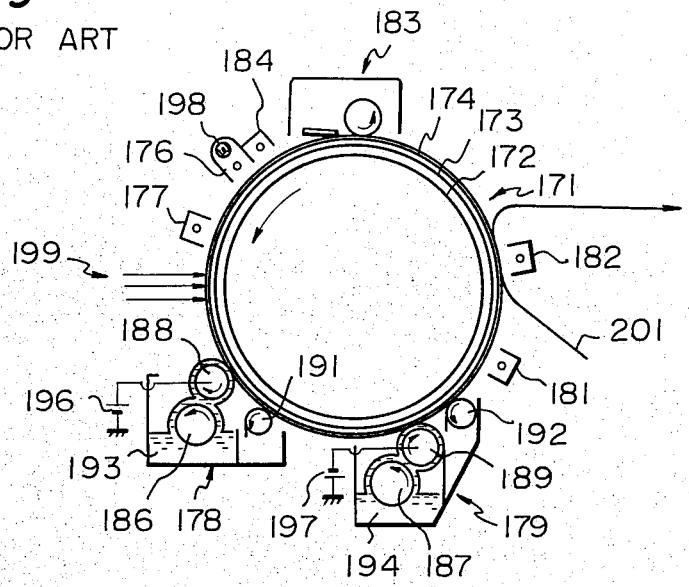
Fig. 17 PRIOR ART
FIG. 17 is a schematic view of another prior art copying apparatus.

The present invention will hereinafter be described with reference to the accompanying drawings. Referring to FIG. 17, there will first be described an example of a bicolor electrophotographic system. A photosensitive drum 171 is rotatable counterclockwise at a constant rate and comprises a conductive support 172, a first photoconductive layer 173 insensitive to red light and formd on the support 172 and a second photoconductive layer 174 sensitive to red light and formed on the layer 173. Arranged around the drum 171 and successively from an upper left portion along the direction of rotation are a first charger 176, a second charger 177, a first developing unit 178, a second developing unit 179, a charger 181 for adjustment, a charger 182 for image transfer, a cleaning unit 183 and a charger 184 for charge dissipation. The first and second developing units 178 and 179 are of the usual type for semimoist development and include draw-up rollers 186 and 187, developing rollers 188 and 189 and squeeze rollers 191 and 192. The first developing unit 178 stores a first developing liquid 193 with a red toner dispersed therein while the second developing unit 179 stores a second developing liquid 194 with a black toner dispersed therein. The red toner in the developer 193 has a negative charge and the black toner in the developer 194 a positive charge. A positive bias voltage source 196 is connected to the developing roller 188 and a negative bias voltage source 197 is connected to the developing roller 189.

The surface of the drum 171 is first charged positively by the first charger 176 while being illuminated by red light emitted from a red lamp 198. The positive charge moves through the photoconductive layer 174 which is rendered conductive by the illumination until it is trapped at the interface between the photoconductive layers 173 and 174. Thereafter, the second charger 177 deposits a negative charge on the drum 171 surface whereby the drum 171 obtains a distribution of negative charge on the surface and a distribution of positive charge at the interface. The surface of the drum 171 is then exposed to image light 199 from a document having black and red images on a white background. White light causes the incident part of the drum 171 to dissipate substantially the entire charge so that the surface potential in this area of the drum 171 falls substantially to zero. Red light incident on the drum 171 causes the second photoconductive layer 174 sensitive to red light to dissipate the negative charge, the surface potential being inverted to positive by the inner positive charge. Substantially no light reaches the drum 171 in the black area so that, in this portion, the surface potential of the drum 171 is negative due to the negative charge on the drum 171 surface. Such distributions of positive and negative charges on the drum 171 form a bipolar latent image. The latent image corresponding to the red area is first developed by the negatively charged red toner supplied thereto from the first developing unit 178 whereupon the latent image corresponding to the black area is developed by the positively charged black toner supplied from the second developing unit 179. These differently colored images on the drum 171 move past the charger 181 to have their polarities uniformalized to negative. Subsequently, a transfer sheet 201, is pressed on the toner images and the transfer charger 182 is energized to deposit a positive charge for thereby transferring the bicolor image onto the sheet 201. The sheet 201 is then separated from the drum 171 surface, dried and discharged to the outside of the machine. The cleaning unit 183 removes residual particles of the toner while the charger 184 dissipates the charge remaining on the drum 171.

Figure 18:
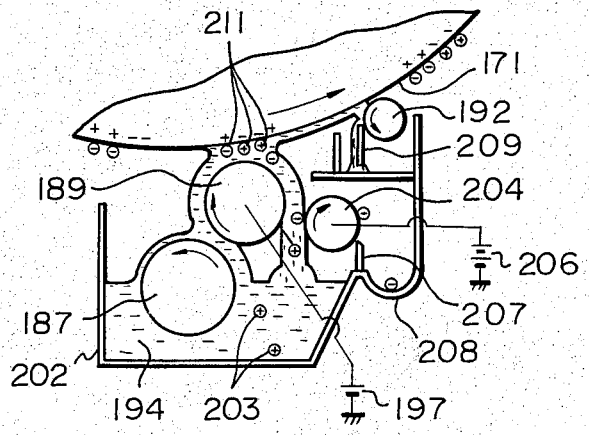
FIG. 18 is a fragmentary view showing how the present invention improves on the apparatus of FIG. 17.

Reference will now be made to FIG. 18 for discussing the second developing unit embodying the present invention. A container 202 stores a given volume of liquid developer 194 containing a black toner 203. The draw-up roller 187 is accommodated in the container 202 with its substantially lower half immersed in the developer 194 and rotatable counterclockwise. The conductive developing roller 189 is rotatable clockwise and neighbors the draw-up roller 187 at its lower part and the drum 171 at its upper part. The positive bias voltage source 197 is connected to the developing roller 189 to impress a voltage of about 150–200 V thereon. As is conventional, the polarity of the bias voltage source 197 may be negative which is opposite to the charge polarity of the positive black toner. A conductive separator roller 204 rotates clockwise and neighbors the right-hand side of the developing roller 189. The roller 204 is connected to a positive bias voltage source 206 which provides a bias voltage two to four times the bias voltage provided by the voltage source 197. The right-hand side of the separating roller 204 is engaged by a blade 207 which extends in such a direction as to oppose the rotating direction of the roller 207. The side wall of the container 202 located to the right and below the blade 207 is recessed downwardly to constitute a toner collector 208 through the collector 208 may be an independent container. The squeeze roller 192 is adapted to remove excess developer adhered to the drum 171 surface and is equipped with a blade 209 for removing the toner adhered to the roller 192 surface.

The surface of the drum 171 carries thereon a negatively charged red toner 211 adhered to a positively charged latent image by the first developing unit 178. At this part of the drum 171 carrying the red toner 211 reaches the developing station of the second unit, the developer 194 supplied by the roller 187 onto the roller 189 contacts the drum 171 surface and causes the black toner 203 to adhere to the negatively charged latent image to thereby develop the same. At this instant, particles of the negative red toner 211 adhered to a relatively low potential latent image portion are removed by the positive bias voltage applied to the developing roller 189 and thus mixed in the developer which performed development. This admixed part of the red toner 211 is then attracted onto the separating roller 204 applied with a positive voltage higher than that on the developing roller 189. The roller 204 carries the red toner 211 until the blade 207 scrapes it off into the collector 208. Meanwhile, the positive black toner 203 in the developer 194 is urged toward the developing roller 189 by the potential gradient between the positively charged rollers 189 and 204 but is returned into the developer 194 in the container 202 without adhering to the roller 189.

The illustrated embodiment has employed a roller type developing process and allows the developing roller 189 to bifunction as a developing electrode. It will be noted, however, that the present invention is applicable also to a down-flow type process or a jet type process which uses a developing tray storing a developing liquid while functioning as a developing electrode. In such a case, the separating roller 204 will be located in a position where a developer is to be collected from the developing tray. The separating roller may take the form of a belt while the colors of the toners are not limited to red and black.

In summary, a system according to the present invention allows the first toner mixed in the second liquid developer located in the second developing region to be separated before the second developer is collected in a container. Thus, the system of the invention avoids degradation of the quality of reproduced images attributable to mixing and deterioration of the second liquid developer.

Figure 19:
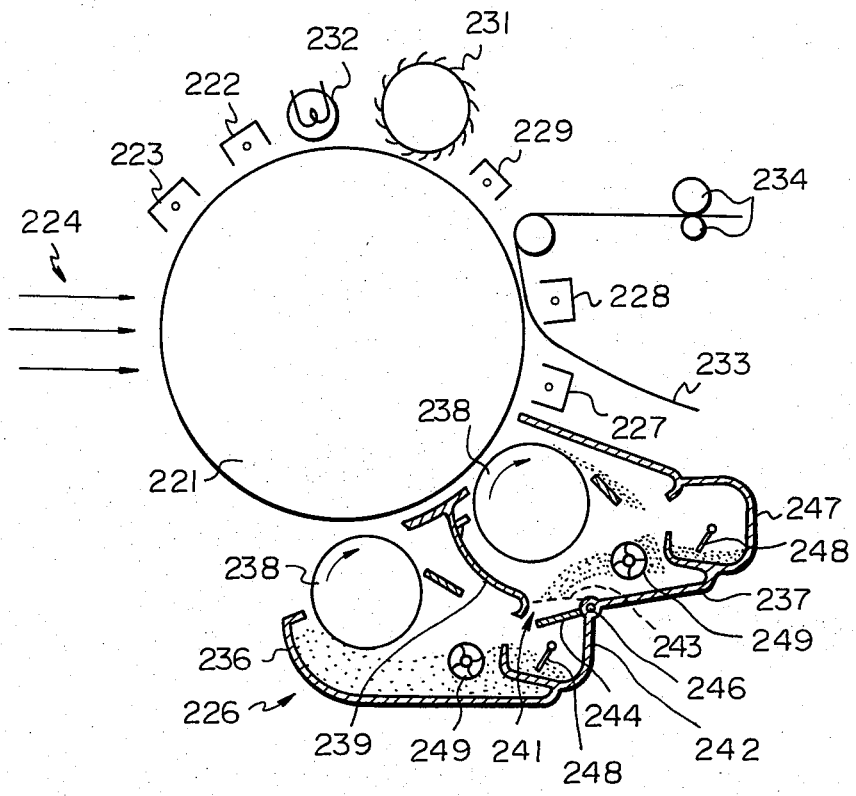
FIG. 19 is a schematic view of another electrostatic copying apparatus embodying the present invention.

Referring now to FIG. 19, a photosensitive drum 221 comprises a conductive layer, a first photosensitive layer and a second photosensitive layer arranged concentrically. Located around the drum 221 are a primary charger 222, a secondary charger 223, an exposure station 224, a developing system 226 embodying the present invention, a charger 227, a transfer charger 228, a charge dissipating charger 229, a cleaning unit 231 and a quenching lamp 232. The drum 221 is charged to positive and negative polarities sequentially by the primary and secondary chargers 222 and 223 and then exposed to image light at the exposure station 224 to be formed with latent images electrostatically thereon. The developing system 226 processes the latent images with red and black toners whereupon the transfer charger 228 transfers the toner images from the drum 121 to a copy sheet 233. Finally, fixing rollers 234 fix the toner images on the paper sheet 233.

The developing system 226 comprises a first container 236 storing a developer with a red toner and a second container 237 located above the first container 236 and storing a developer with a black toner. Each of the containers 236 and 237 accommodates therein a rotatable sleeve 238 adapted to supply the corresponding developer onto the drum 121.

A partition wall 239 isolates the first and second containers 236 and 237 and has an opening or passageway 241 immediately above a toner supplementing tank 242. A mesh 243 is disposed in the opening 241. Made of a conductive material, the mesh 243 has a number of apertures which permit toner particles to pass therethrough but not carrier particles. The mesh 243 is grounded. Positioned below the mesh 243 is an electrode 244 which moves about a pivot point 246 in accordance with the action of driving means not shown to selectively open and close the opening 241. A voltage is applied to the electrode 244. An electric field develops between the electrode 244 and grounded mesh 243. This electric field serves to cause toner particles alloted to the first container 236 and admixed in the second container 237 to adhere to the electrode 244. The reference numerals 247, 248 and 249 denote a toner supplementing tank for the second container 237, supplying members and agitators respectively.

Figure 20:
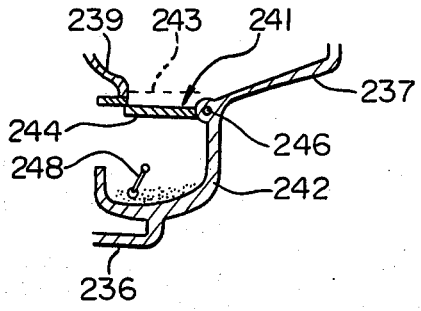
FIG. 20 is an enlarged view showing part of the apparatus of FIG. 19.

When the copying machine is out of operation, the electrode 244 remains de-energized and, as viewed in FIG. 20 assumes a position closing the opening 241.

Upon depression of a copy start button (not shown), a voltage is applied to the electrode 244 while the electrode 244 swings downwardly as shown in FIG. 19 to unblock the opening 241. An electric field thus established between the mesh 243 and electrode 244 causes the electrode 244 to attract only the toner particles alloted to the first container 236 and admixed in the second container 237. When the amount of the toner particles deposited on the electrode 244 increases to a certain value, the particles drop into the tank 242 associated with the first container 236.

This prevents the toner particles of the first container 236 from adversely influencing the chroma of the toner particles stored in the second container 237.

In summary, a developing system according to this embodiment includes a first developer container, a second developer container connected to and located above the first container, a partition wall interposed between the first and second containers and having an opening therethrough, a conductive mesh and an electrode disposed in the opening of the partition wall. The mesh is grounded to develop a potential difference between the mesh and electrode whereby toner particles introduced from the first container into the second are favorably recirculated into the first. Toner particles in the second container can thus maintain the desired chroma.

Figure 21:
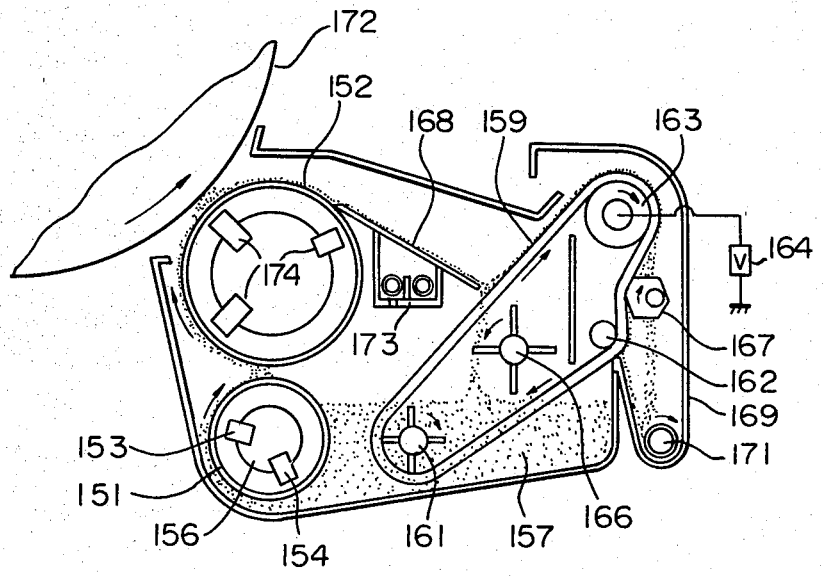
FIG. 21 is a schematic view showing another apparatus embodying the present invention.

Another second developing unit according to the invention is illustrated in FIG. 21. A draw-up sleeve 151 is positioned below a developing sleeve 152 and rotatable clockwise. Magnets 153 and 154 are mounted on a fixed shaft 156 within the sleeve 151. A black developer 157 is adhered to the draw-up sleeve 151 and then transferred onto the developing sleeve 152. A separator belt 159 comprises a single flat and broad conductive spring coil belt or multiple conductive spring coil belts of conventional type having a circular cross section. The belt 159 is passed over a bladed wheel 161, a roller 162 disposed above the bladed wheel 161 and a drive roller 163 disposed above the roller 162. The drive roller 163 is connected to a bias voltage source 164 of a polarity opposite to that of red toner. Another example of the separator belt 159 may be a conductive mesh belt with or without an insulating layer deposited thereon. A bladed wheel 166 is accommodated in the loop formed by the separator belt 159 while a polygonal eccentric roller 167 contacts a portion of the belt 159 intervening between the rollers 162 and 163.

The black developer with red toner particles removed by a scraper 168 from the sleeve 152 falls from the lower end of the inclined scraper 168 onto the belt 159 which is charged to a polarity opposite to that of the red toner. Then the black toner particles and carrier particles of the developer drop through numerous spacings provided in the belt 159. Meanwhile, the alien red toner particles are adhered to the belt 159 and conveyed thereby until the eccentric roller 167 repeatedly shakes or hammers the belt 159 to drop the red toner into a collector 169. An auger or screw 171 conveys the red toner particles from the collector 169 to the outside of the system. Where the developer passed through the belt 159 still contains red toner particles, the bladed wheel 166 in rotation agitates the developer into convection for thereby allowing the red toner particles to adhere to the belt 159. It will be appreciated that the belt 159 constantly oscillates with the action of the eccentric roller 167 and thereby promotes far more effective separation of the red toner from the black developer.

While is has been red toner particles in the foregoing description that are separated from the black developer, black toner particles which must have been charged to a polarity opposite to that of the red toner particles may happen to have the same polarity as that of the red toner particles depending on various conditions. Such needless black toner will be removed together with the alien red toner. It should be born in mind that the colors of toners applicable to the present invention are not limited to red and black.

Though the present invention has been shown and described in connection with the use of a developer made up of a toner and a carrier, it is similarly applicable to a developer consisting only of a toner. It will readily occur that, where the one-component developer comprises a non-magnetic toner, the magnets are needless and the construction of the developing roller is modified. Additionally, the developer supplying member typified by a developing roller 152 may be replaced by a developing belt.

A photoconductive drum is designated as 172 whereas a toner supply means is designated as 173. Magnets 174 are displaced in the roller 152.

A bicolor electrophotographic machine has a developing system that is capable of not only bicolor development but monochromatic development using either one of the two developing units. For example, only the black toner in the second developing unit may be used for ordinary black-white image reproduction. Practical apparatus is frequently operated in such a mode. Mixing of differently colored toners does not occur in monochromatic or one color reproduction using only the second developing unit alone. With this in mind, in a known apparatus using a separating roller, a bias voltage source is disconnected from the separator roller in the one color mode to render the separator roller inoperative. However, though the bias voltage source may be disconnected, the separator roller itself keeps on rotating so that black toner particles in the unit adhere to the separator roller under the action of Van der Waals forces and the like. Black toner particles thus deposited on the separator roller are unwantedly scraped off therefrom with the result that the content of the black toner in the developer progressively decreases.

A second developing unit according to the present invention includes a separator roller, a member for scraping off toner particles adhered to the separator roller, a container for collecting the removed toner particles and means for preventing the separator roller from removing the second developing toner in a developing mode which uses only the second developing unit. Means for preventing the removal of the second toner may be typified by making it possible to stop the rotation of the separator roller or to shield a portion above the separator roller or to move the scraping member into and out of engagement with the separator roller. Any of such means can prevent the separating roller from removing the second toner and, thus, avoids unnecessary consumption of the second toner in the second developing unit.

Figure 22:
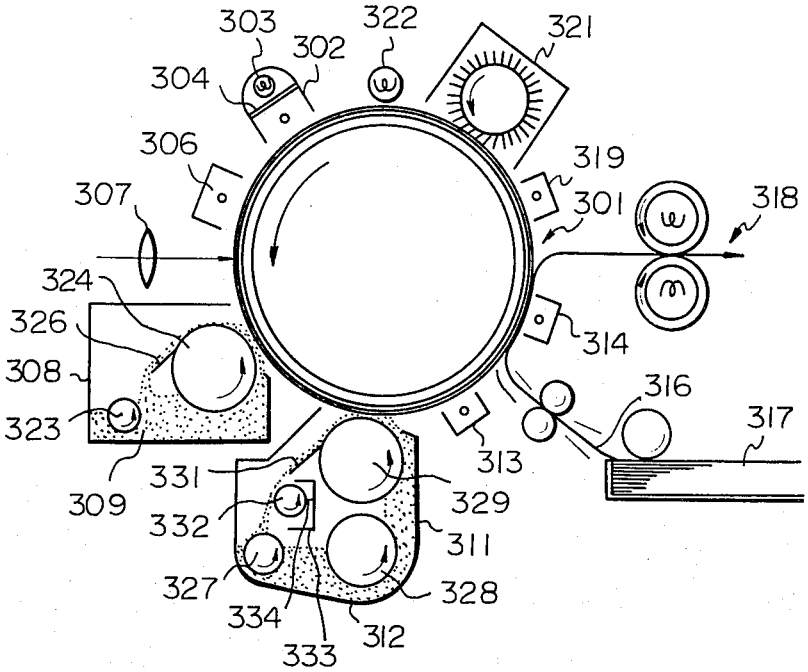
FIG. 22 is a schematic view of another apparatus.

FIG. 22 schematically illustrates an exemplary apparatus for bicolor electrophotography to which the present invention is applicable. A photosensitive drum 301 has first and second photoconductive layers formed in succession on a conductive core. The drum 301 is first applied with a primary charge by a primary charger 302 or subjected to simultaneous charging and red light exposure effected by the primary charger 302 and a white lamp 303 and a red filter 304. This is followed by secondary charging which a secondary charger 306 performs to deposit a secondary charge opposite in polarity to the primary charge on the drum 301. Then, a light image of a document having red and black images on a white background is projected onto the photosensitive drum 301 through an optical system 307 whereby oppositely charged latent images corresponding to the red and black areas are formed on the drum 301. The two latent images now carried on the drum 301 are developed sequentially by a first developing unit 308 storing a red developer 309 and a second developing unit 311 storing a black developer 312. The red developer 309 consists of a red toner and a magnetic carrier and the red toner is charged to a polarity opposite to that of the latent image corresponding to the red image by friction with the carrier. Likewise, a black toner and a magnetic carrier constitute the black developer 312 while the black toner is charged by friction with the carrier to a polarity opposite to that of the latent image corresponding to the black image. A charger 313 uniformalizes the polarities of the red and black toner images on the drum 301 to a predetermined polarity whereafter a transfer charger 314 transfers the toner images onto a paper sheet 316 fed thereto from a sheet cassette 317. Then a fixing unit 318 permanently fixes the toner images to the paper sheet 316. In the meantime, the surface of the drum 301 has its charge dissipated by a charger 319, its residual toner particles removed by a cleaning unit 321 and its residual charge removed by a quenching lamp 322.

The first and second developing units 308 and 311 are of the known magnetic brush type. The first unit 308 includes an agitating shaft 323, a developing sleeve 324 and a scraper plate 326 whereas the second unit 311 includes an agitating shaft 327, a draw-up sleeve 328, a developing sleeve 329 and a scraper plate 331. The developers stored in the units 308 and 311 are stirred by the corresponding shafts 323 and 327 and thereby charged by friction to the aforementioned polarities. Each of the developing sleeves 324 and 329 and draw-up sleeve 328 have magnets therein though not shown. The developer in each unit is magnetically adhered to the developing sleeve 324 or the developing sleeve 329 via the draw-up sleeve 328 so as to be conveyed by their rotation. The latent images on the drum 301 are developed by the developing units 308 and 311 in positions where the developing sleeves 324 and 329 are the nearest to the drum 301 surface. The scraper plates 326 and 331 shave off the developers on the sleeves 324 and 329 after the development and collect them in bottom portions of the individual units 308 and 311.

Disposed below the scraper plate 331 of the second unit 311 is a separator roller 332 comprising a conductive member with or without an insulating layer deposited thereon. A container 333 embrances the separator roller 332 on one side of the latter. Within the container 333, a scraper member 334 contacts the surface of the separator roller 332. Where the surface of the separator roller 332 is insulative, said surface will be charged to a polarity opposite to that of the charge polarity of the red toner by friction with the carrier of the developer 312. Where the surface of the separator roller 332 is conductive, a potential of such a polarity will be provided by an external d.c. power source.

In a bicolor mode of operation, a part of the red toner shaved off by the developer on the sleeve 329 from the drum 301 flows down the scraper plate 331 together with the occupant developer. While the developer with the red toner particles drops in contact with the surface of the rotating roller 332, the red toner particles adhere to the roller 332 and are conveyed thereby. Thereafter, the scraper member 334 removes the red toner particles from the separator roller 332 into the container 333.

Figure 23:
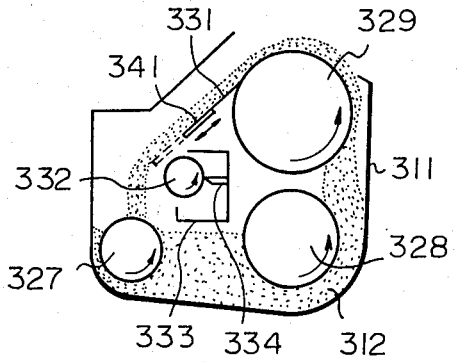
FIGS. 23 and 24 are fragmentary views illustrating modifications of the present apparatus.
Figure 24:
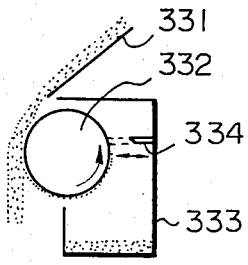

In a monochromic mode of operation using the second unit 311 alone, the respective members in the first unit 308 are rendered inoperative while the second unit 311 has the separator roller 332 rendered non-rotatable. Accordingly, even if black toner particles are present on the separator roller 332 which is now non-rotatable, they are prevented from being conveyed by the roller 332 and removed by the scraper member 334. Alternatively, instead of interrupting the rotation of the separator roller 332, a screening or shield member 341 may be slidably mounted on the underside of the scraper plate 331 as viewed in FIG. 23 so as to shield the roller 332 from above. In another alternative, the upper wall of the container 333 may be designed to be movable to a position above the separator roller 332. With such a design, the developer flowing down the scraper plate 331 is prevented from contacting the separator roller 332 to avoid deposition of the black toner on the roller 332. In a further alternative, as shown in FIG. 24, the scraper member 334 may be arranged to become disengaged from the roller 332 without interrupting the rotation of the roller 332 in the operating mode concerned. In this case, black toner, if present on the separator roller 332, are not scraped off by the member 334 but are scraped by the developer flowing down the plate 331.

The separator roller 332 in the arrangement of FIG. 22 can have its rotation stopped simply by an electromagnetic clutch or the like mounted on a drive shaft thereof. The screening member 341 and scraper 334 in FIGS. 23 and 24 can be readily actuated by solenoids or like means.

In summary, it will be seen that the present invention overcomes the drawbacks of the prior art and provides a multi-color electrostatic copying apparatus capable of improved color purity over the prior art. Various modifications will become possible for those skilled in the art after receiving the teachings of the present disclosure without departing from the scope thereof.

What is claimed is:

1. A multi-color electrostatic copying apparatus including a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, characterized by comprising:

toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity;

the separation member being positioned such that the first and second toner contact the separation member after the second developing means applies the second toner to the photoconductive member.

2. An apparatus as in claim 1, in which the second developing means comprises a rotary application member for applying the second toner to the dielectric member, the separation member being disposed downstream of the dielectric member in a direction of rotation of the application member.

3. An apparatus as in claim 2, in which the separation member is disposed in close proximity to the application member.

4. An apparatus as in claim 3, in which the separation member comprises a rotating roller.

5. An apparatus as in claim 4, in which the separation means further comprises scraper means for scraping the first toner from the roller.

6. An apparatus as in claim 2, in which the separation means further comprises scraper means for scraping first and second toner from the application member and being slanted downwardly so that the first and second toner slides down the scraper means onto the separation member.

7. An apparatus as in claim 6, further comprising means for scraping the first toner off the separation member.

8. An apparatus as in claim 6, in which the separation member comprises a rotating endless belt.

9. An apparatus as in claim 1, in which the separation member comprises a rotary member positioned such that the first and second toner contact the rotary member after the second developing means applies the second toner to the photoconductive member.

10. An apparatus as in claim 9, in which the rotary member comprises an electrically insulative outer surface formed of a material selected such that the material is charged to the second polarity by frictional engagement with the second toner.

11. An apparatus as in claim 9, in which the rotary member comprises an electrically conductive outer surface, the separation means further comprising power source means for applying the charge of the second polarity to the outer surface.

12. An apparatus as in claim 1, in which the separation means further comprises means for returning the separated first toner to the first developing means.

13. An apparatus as in claim 1, further comprising a detachable container for receiving the separated first toner from the separation member.

14. A multi-color electrostatic copying apparatus including a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, characterized by comprising:

toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity; and means for removing the charge of the second polarity from the separation member for operation of the apparatus for one color copying using only the second developing means, the separation means further comprising disable means for preventing the second toner from adhering to the separation member.

15. An apparatus as in claim 14, in which the separation member comprises a rotating roller, the disable means comprising means for stopping rotation of the roller.

16. An apparatus as in claim 14, in which the separation means further comprises scraper means for scraping the first toner from the separation member, the disable means comprising means for moving the scraper means away from the separation member.

17. A multi-color electrostatic copying apparatus including a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, characterized by comprising:

toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity; and means for removing the charge of the second polarity from the separation member for operation of the apparatus for one color copying using only the second developing means, the separation means further comprising disable means for preventing the second toner from adhering to the separation member;

the disable means further comprising a shield member movable to a position to prevent the second toner from contacting the separation member.

18. A multi-color electrostatic copying apparatus including a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, characterized by comprising:

toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity;

the second developing means comprising a rotary application member for applying the second toner to the dielectric member, the separation member being disposed downstream of the dielectric member in a direction of rotation of the application member;

the separation means further comprising scraper means for scraping first and second toner from the application member and being slanted downwardly so that the first and second toner slides down the scraper means onto the separation members;

the separation member comprising an electrically conductive, rotating endless belt formed with openings large enough to allow the second toner to drop therethrough.

19. An apparatus as in claim 18, further comprising a non-circular rotating member engaging with the belt and causing the belt to shake and the first toner to drop therefrom.

20. A multi-color electrostatic copying apparatus including a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, characterized by comprising:

toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity;

the first and second toners each comprising large carrier particles and small toner particles, the separation means further comprising a mesh covering the separation member formed with openings large enough to allow the toner particles to pass therethrough but small enough to prevent the carrier particles from passing therethrough.

21. An apparatus as in claim 20, in which the mesh is electrically grounded.

22. A multi-color electrostatic copying apparatus including a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, characterized by comprising:

toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity;

the first and second toners each comprising large carrier particles and small toner particles, the separation means further comprising a mesh covering the separation member formed with openings large enough to allow the toner particles to pass therethrough but small enough to prevent the carrier particles from passing therethrough;

the separation member further comprising a passageway leading from the second developing means to the first developing means, the separation member being movable between a first position in which the separation member blocks the passageway and a second position in which the separation member unblocks the passageway, the separation means further comprising means for removing the charge from the separation member when the separation member is in the first position.

23. A multi-color electrostatic copying apparatus including a moving dielectric member, means for forming a bipolar electrostatic image on the dielectric member, first developing means for applying a first toner charged to a first polarity to the dielectric member and second developing means for applying a second toner charged to a second polarity which is opposite to the first polarity to the dielectric member, characterized by comprising:

toner separation means disposed in the second developing means for separating first toner which was removed from the dielectric member while the second developing means applied the second toner to the dielectric member and mixed with the second toner in the second developing means from the second toner, the separation means comprising a separation member charged to the second polarity;

the first and second toners each comprising large carrier particles and small toner particles, the separation means further comprising a mesh covering the separation member formed with openings large enough to allow the toner particles to pass therethrough but small enough to prevent the carrier particles from passing therethrough;

the mesh member being in the form of a tube surrounding the separation member.

24. An apparatus as in claim 23, in which the tube is driven for rotation.

25. An apparatus as in claim 23, in which the separation member is in the form of a screw and is intermittently rotated to convey away the first toner.

* * * * *